US008479323B2

(12) United States Patent
Blum

(10) Patent No.: US 8,479,323 B2
(45) Date of Patent: Jul. 9, 2013

(54) SPRING-MOUNTED VERTICALLY HELD TOILET SEAT

(75) Inventor: Jonathan Blum, San Francisco, CA (US)

(73) Assignee: Jonathan Blum, San Francisco, CA (US)

( * ) Notice: Subject to any disclaimer, the term of this patent is extended or adjusted under 35 U.S.C. 154(b) by 330 days.

(21) Appl. No.: 13/075,765

(22) Filed: Mar. 30, 2011

(65) Prior Publication Data

US 2012/0246812 A1 Oct. 4, 2012

(51) Int. Cl.
*A47K 13/10* (2006.01)
*A47K 13/04* (2006.01)

(52) U.S. Cl.
USPC ..... 4/246.1; 4/246.4; 4/246.3; 4/241; 4/248

(58) Field of Classification Search
USPC ..... 4/246.1–246.4, 241, 248
See application file for complete search history.

(56) References Cited

U.S. PATENT DOCUMENTS 2,877,469 A 3/1959 Johnson
3,653,077 A 4/1972 Warnberg
4,402,092 A 9/1983 Smallwood
4,817,242 A 4/1989 Rapp
4,965,890 A 10/1990 Fischer
5,379,465 A 1/1995 Vaughn
5,642,532 A 7/1997 Morant
5,875,498 A * 3/1999 Joseph ..... 4/246.5
6,012,180 A 1/2000 Williams
6,230,335 B1 5/2001 Miller
6,526,600 B1 * 3/2003 Hernandez ..... 4/246.1
6,941,588 B1 * 9/2005 Oprandi ..... 4/246.1
2007/0079430 A1 * 4/2007 Herrera-Gurrola ..... 4/246.1

* cited by examiner

*Primary Examiner* — Gregory Huson
*Assistant Examiner* — Christine Skubinna
(74) *Attorney, Agent, or Firm* — Norris McLaughlin & Marcus, P.A.

(57) ABSTRACT

A mounting mechanism for toilet seats is provided which includes an easy accessible pull handle, connected to a mechanism associated with the seat that holds the seat in a vertical rest position. The handle is the only part that needs to be maneuvered by the toilet user when the user desires that the seat be in horizontal position. After using the seat in such horizontal position, the provided mechanism automatically moves the seat back up into the vertical rest position. This mechanism eliminates handling of potentially unsanitary toilet seats with hands. Thus, the handle is the only part which the person using the toilet is touching. Since the handle is positioned away from the seat and outside of the area where typically splashing occurs, an utmost sanitary and hygienic state is accomplished by the current invention.

9 Claims, 11 Drawing Sheets

SPRING-MOUNTED VERTICALLY HELD TOILET SEAT

BACKGROUND OF THE INVENTION (1) Field of the Invention

It is a common problem that toilets, particularly toilet seats, are often found in an unsanitary and unhygienic condition. Conventional toilet seats rest in either a horizontal, seated position, or a vertical, raised position depending on how the toilet seat was left by the previous user. Users who find toilet seat in the seated position are frequently unwilling to touch the toilet with their hands in order raise it to a vertical position prior to use. When the toiled seat is left in the seated position, users who are standing or squatting while using the toilet often cause urine or toilet water to deposit on the toilet seat, causing unsanitary and unhygienic conditions. Alternatively, people use their feet to raise or lower the seat to avoid touching the toilet seat with their hands, which often damages or breaks the seat hinge mechanism. These problems are particularly common in public toilets and toilets used by men.

The present invention alleviates these problems by maintaining the toilet seat in the vertical, raised position until the user intentionally chooses to move the toilet in the seated, horizontal, position by pulling a handle. When a user desire to lower the seat from the standard vertical resting position to the horizontal, seated position, he makes an effortless, short pulling motion on the handle which lowers the toilet seat to the horizontal position. This handle is part of a new mounting mechanism that attaches the toilet seat to the toilet pedestal. The handle is located at a distance from the seat so that the handle does not become soiled by splatter or other unsanitary causes from prior users and the user is not required to touch the toilet seat.

After the seat is lowered to the horizontal position using the lever, the seat remains in the horizontal, seated position providing an appropriate interval of time for the user to sit on the seat without having to touch or hold the seat down with their hands, at which point the user's weight maintains the seat in the horizontal position. When the user removes his weight from the seat, the hinge mechanism uses a spring force to slowly raise the seat back to the original vertical resting position, providing a safe and adequate interval for the user to exit the seat before it moves to the vertical position. The lifting mechanism includes a damper which slows the speed in which the seat is moved from the horizontal to the vertical position to prevent damage or injury.

The invention can be used to retrofit on an existing toilet pedestal by replacing the standard toilet seat, or can be included on a new toilet pedestal when the pedestal is installed.

Thus, the invention provides an economical, hygienic and sanitary way of bringing the toilet seat to rest in a hygienic, vertical position while also allowing the user to move a toilet seat to a seated position in a hygienic manner without touching the toilet seat itself.

(2) Description of Related Art

There have been several attempts to provide a mechanism that keeps the seat in an upright or vertical position during use by a male user. Several references disclose toilet seat with devices for either facilitating lifting a seat or holding the seat in an up-right position while the toilet is in use.

U.S. Pat. No. 6,230,335 discloses a normally upright toilet stool-seat assembly, in which a one-piece toilet seat hinge composed of an elastomer material throughout, and including a flat flange member and a coplanar support shank. The flange member is designed to be connected to the toilet seat and the support shank is generally cylindrical in shape and externally threaded to facilitate mounting within a cavity normally found on the toilet stool for connection of the seat thereto. The flange member has lower peripheral portions with sufficient memory to cause the toilet seat to swing from a horizontal orientation, upon release, to a vertically extending orientation, thereby obviating the likelihood of the seat being soiled by a subsequent male urinator.

U.S. Pat. No. 6,012,180 discloses a toilet seat lifting device by utilizing a pair of compound leaf springs which are formed to hold a commode seat in the up position. The leaf springs have a primary curve for spring lifting power, a second curve to reduce friction between the seat and spring when the seat is lowered, and a third curve to act as a spring washer to hold the leaf spring in place between the seat and commode. By holding the seat in the up position unless a user wishes to lower it, the seat is less apt to be soiled when the commode is used for urination.

U.S. Pat. No. 5,642,532 discloses a commode seat raising mechanism including a commode seat; a biasing mechanism in connection between a top wall of a commode and the commode seat for biasing the commode seat in an upright position; and a dampening mechanism in connection between the commode seat and the biasing mechanism for adjusting the rate at which the commode seat is raised.

U.S. Pat. No. 5,379,465 discloses and attachment for a toilet which includes a bracket (A) for securing the attachment to a rim of a toilet bowl positioning a flat spring (B) constructed of resilient flexible material extending beyond the rim and over the open top beneath an overhanging portion of the seat for carrying an upwardly extending protuberance (C) for partially raising the seat due to the force of the flexible material which permits proper lowering of the seat when in use for avoiding wetting of the seat.

U.S. Pat. No. 4,965,890 discloses a spring toilet seat hinge comprising a spring having a leg for pushing a toilet seat from a lowered to a raised position, a helical torsion coil portion, and a linear bracing shank portion. The spring is mounted within the notch of a seat mounting portion, the notch having a round section for receiving the helical torsion coil, and a linear section extending tangentially from the round section, the linear section containing a bracing wall as backstop for the linear shank of the spring. The spring toilet seat hinge also comprises a hinge pin disposed coaxially within the torsion coil section of the spring and mounted to the seat mounting member, and a mounting bolt depending from the bottom of said seat mounting member.

U.S. Pat. No. 4,817,242 discloses a spring hinge for raising a toilet seat, having an adjustable spring force. First and second hinge members with hinge knuckles that interfit closely end-to-end are attachable respectively to the toilet bowl and the seat. A rod extends through the knuckles and is slidably received in end caps on the hinge members at opposite ends. A first coupling member on the rod presents a series of teeth extending circumferentially around the rod and facing toward the end cap on the second hinge member. A second coupling member on the inside of the second hinge member's end cap has similar teeth which engage the teeth of the first coupling member. A coil spring encircles the rod inside the hinge knuckles and is fastened at one end to the end cap of the first hinge member and at the opposite end to the first coupling member to normally hold the first coupling member in toothed engagement with the second coupling member. The rod may be pushed to disengage the coupling members, after which the rod may be turned to adjust the force of the spring.

U.S. Pat. No. 4,402,092 discloses a hinged toilet seat that is spring-biased to either an upright or a horizontal position is slowed in its angular rotation to the spring-biased position. The user manually pushes the toilet seat to its use position and after use the toilet seat returns to its spring-biased position. This angular rotation is slowed by the present mechanism wherein the seat is attached to a hinge shaft which has a large gear engaging a small gear on an idler shaft. The rotation of the idler shaft is braked by a slipping clutch, which thereby slows the angular motion of the toilet seat to its spring-biased position.

U.S. Pat. No. 3,653,077 discloses a quick detachable toilet seat hinge structure for a toilet construction including a bowl having a seat pivotally mounted thereon by means of a hinge structure which includes one or more socket engaging protuberances, or post receiving apertures or openings. The socket engaging protuberances are adapted to be projected into sockets formed either in a cylindrical sleeve forming another portion of the hinge structure, or one or more sockets formed in the rear portion of the bowl. The water closet structure further includes a tank which is mounted on the rear side of the bowl, and supported on the bowl by a spacing device which spaces the tank upwardly from the horizontal upper surface of the bowl. The water closet structure may further include a lid having at least two arms connected thereto and having either socket engaging protuberances on the arms which fit into hollow sockets which may be formed in another portion of the hinge structure or in the bowl, or having apertures therein which detachably engage posts carried on the bowl.

U.S. Pat. No. 2,877,469 discloses a toilet seat raising device which includes means for swinging a hinged toilet upwardly of a toilet bowl by utilizing a horizontal bar which is attachable to the bowl beneath the hinge of the seat. An upstanding integral arm on one end thereof provided with an aperture therein a stud bolt having a head and a reduced end extended through the aperture for rotary adjustment of the bolt and forming a shoulder on the bolt. A longitudinal slot in the bolt extending to the shoulder, a clock spring having a coil surrounding the bolt between the head and the shoulder and having a free end bearing upwardly against the seat. The coil has a terminal lip fixed in the slot for winding up the coil in response to rotary adjustment of the bolt for uncoiling of the coil to swing the free end of the spring upwardly. An apertured stop plate on the reduced end of the stud between the shoulder and the upstanding arm and having a lateral flange overlying the coil to limit uncoiling thereof, and a nut on the reduced end of the stud for clamping the stop plate between said shoulder and upstanding arm and thereby retaining the stud in rotatably adjusted position. The stop plate has a second lateral flange thereon engaging and overlying the arm to prevent the stop plate from being turned by the coil when the stud is adjusted.

None of this prior art provides a seat arrangement which includes a mechanism that is (i) cost-effectively manufactured; (ii) activated by a hygienic hand lever that is easily maneuvered and located remote from the seat; (iii) provides an adequate period in which the seat stays in the horizontal position for the user to sit on the seat without having to hold the seat down or touch it in any other way; (iv) has a dampened mechanism that slows the raising of the seat to allow the user an adequate time to safely exit the seat after use; and (v) automatically returns the seat to a hygienic vertical position using a safe, dampened mechanism after the user has finished.

BRIEF SUMMARY OF THE INVENTION

The foregoing disadvantages of the prior art are overcome by providing a mounting mechanism for a toilet seat which includes a handle, easy accessible, but yet removed from the toilet, which is connected to a mechanism associated with the seat that holds the seat in a vertical position. The handle is the only part that needs to be maneuvered by the toilet user when the user desires that the seat be in horizontal position in order to sit on it. After using the seat in such horizontal position, the provided mechanism moves the seat back up into the vertical position without the need to interact with the lifting mechanism. Thus, the handle is the only part touched by the person using the toilet. Because the handle is positioned away from the seat and outside of the area where typically splashing occurs, an utmost sanitary and hygienic state is accomplished by the current invention. Accordingly, a toilet seat lifting assembly is provided for maintaining a toilet seat in a vertical rest position when the seat is not in use, the assembly comprising a toilet seat including two fixed hinge supports, an outer casing arranged between the two hinges, a pull handle having a shaft and a base rod, the shaft being connected in a four-bar-link) via a first pin to a link, the link being connected via a second pin with a pivotal L-shaped link. The base rod terminates in a first opening provided in the outer casing. A first torsion spring is fitted over the base rod and is, upon assembly, arranged in the first opening such that upon pivoting the pull handle out of a vertical rest position, the first torsion spring is tensioned and upon releasing the pull handle, the torsion spring urges the pull handle back into the rest position. Upon pulling the handle, the L-shaped link is pivotally guided via a third pin into a second opening in the outer casing, such that the L-shaped link contacts the toilet seat and, upon pivoting the pull handle out of the rest position, the L-shaped link pushes the seat down and upon relaxing of the pull handle, the torsion spring forces the seat up to move back into the vertical position.

The toilet seat lifting assembly also includes a damping mechanism housed in the outer casing.

The damping device engages with at least one seat hinge. The damping mechanism comprises a generally cylindrical hollow outer shaft, and has at least one guide rail extending axially outside of the outer shaft and a row of teeth extending axially inside the hollow shaft. The hollow outer shaft loosely houses a, also generally cylindrical solid inner shaft. A damping fluid is contained between the loosely fitting solid shaft and the inside of the hollow shaft. Further, the hollow outer shaft includes a row of teeth extending axially on the outside. The solid shaft further includes two end portions, one of which is a fitted head portion. Both end portions protrude from the hollow shaft upon assembly. The end portion opposite of the fitted head portion is provided with a second tension spring when mounted in the third opening. The row of teeth of the hollow shaft and the row of teeth of the solid shaft loosely mesh upon rotation of the solid shaft.

The fitted head portion pivotably engages with one of the seat hinge supports. The third opening includes at least one guide rail groove which extends in axial direction and which is adapted to engage with the at least one guide rail of the hollow shaft.

It is also contemplated by the invention to utilize two damping mechanisms, housed in the same guide way opening in minor image position, such that each fitted head portion of the solid shaft engages in a seat hinge support.

BRIEF DESCRIPTION OF THE SEVERAL VIEWS OF THE DRAWING(S)

In the drawings, wherein like reference numerals delineate similar elements throughout the several views.

Figure 16A:
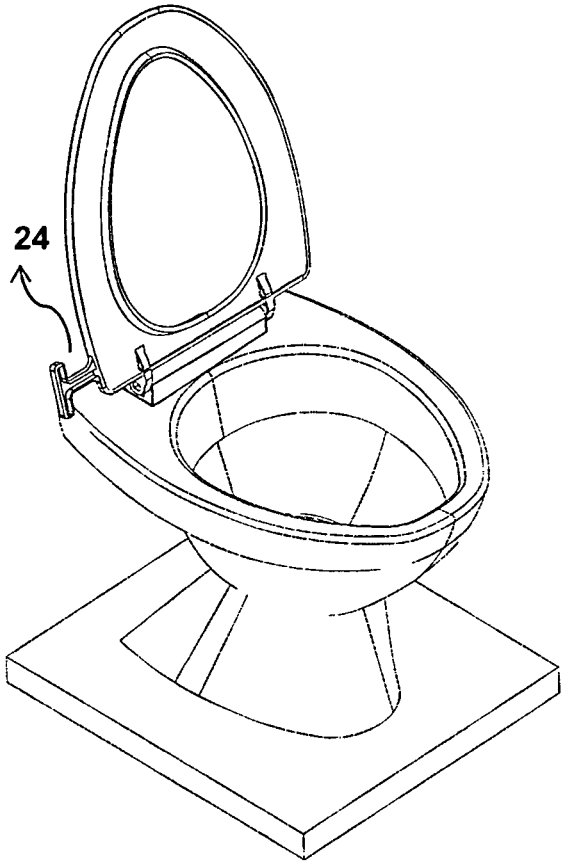
Figure 16B:
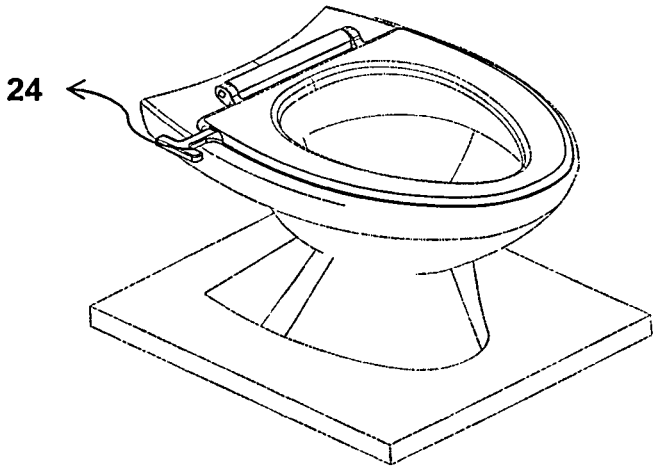

FIGS. 16 A and B illustrate an embodiment in which the handle is integrated into the seat.

DETAILED DESCRIPTION OF THE INVENTION

Figure 1:
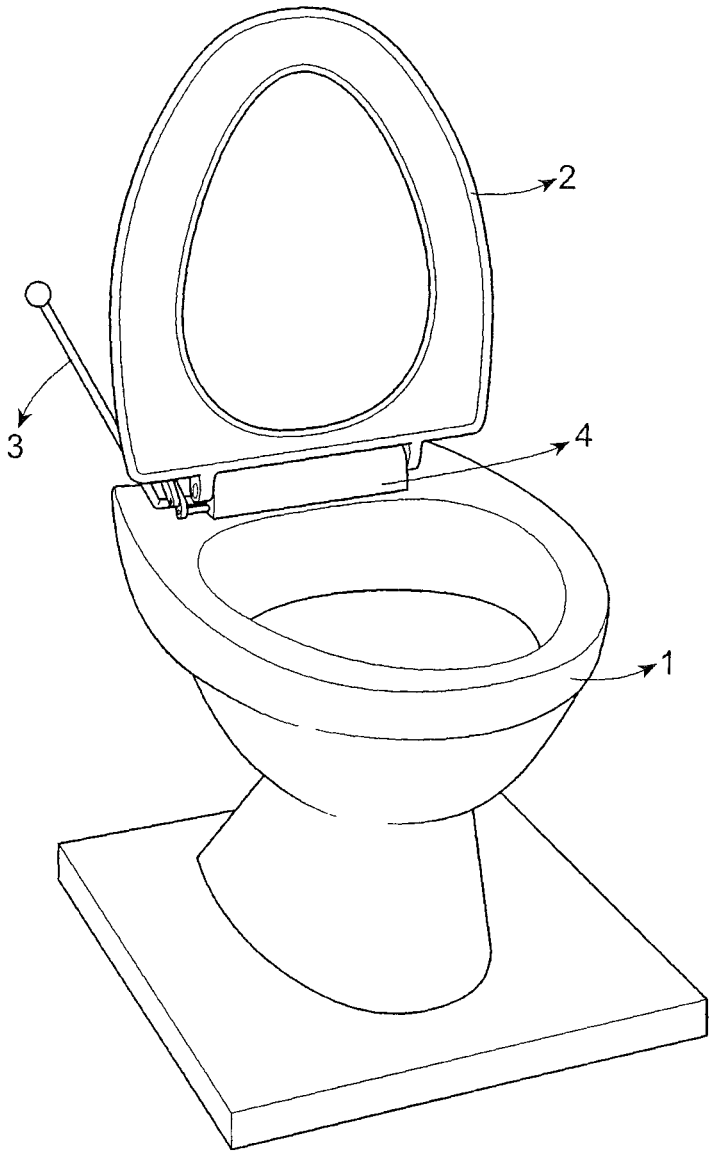
FIG. 1 illustrates a full perspective view of the invention as it is utilized on a toilet bowl.
Figure 2:
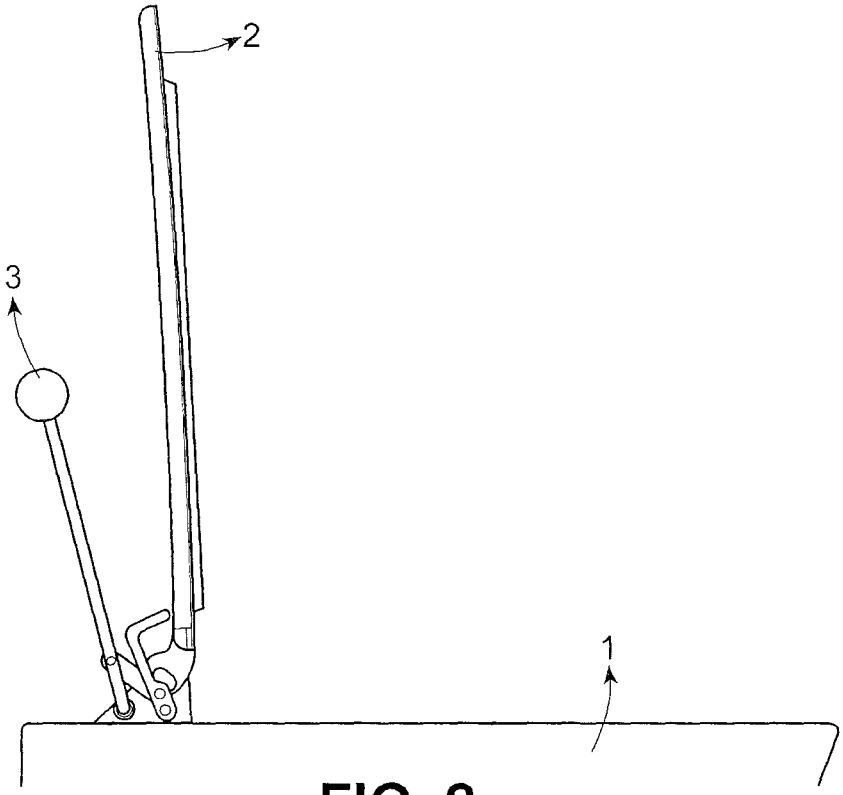
FIG. 2 illustrates a side elevation of the seat in its vertical rest position.
Figure 3:
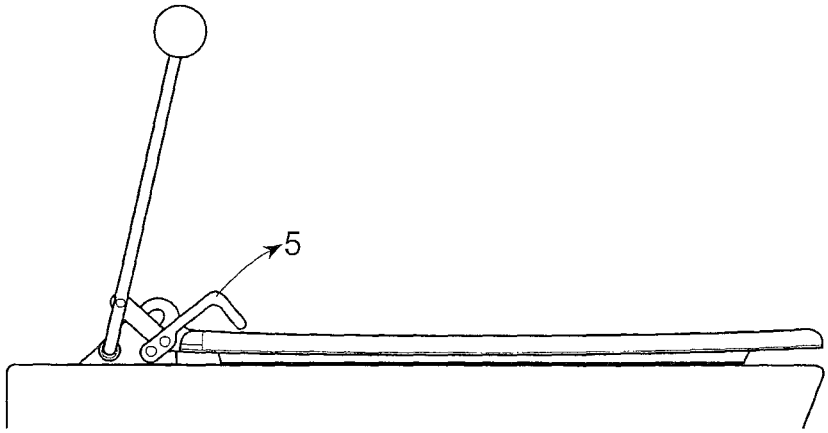
FIG. 3 illustrates the side elevation of the seat in its horizontal position.
Figure 4:
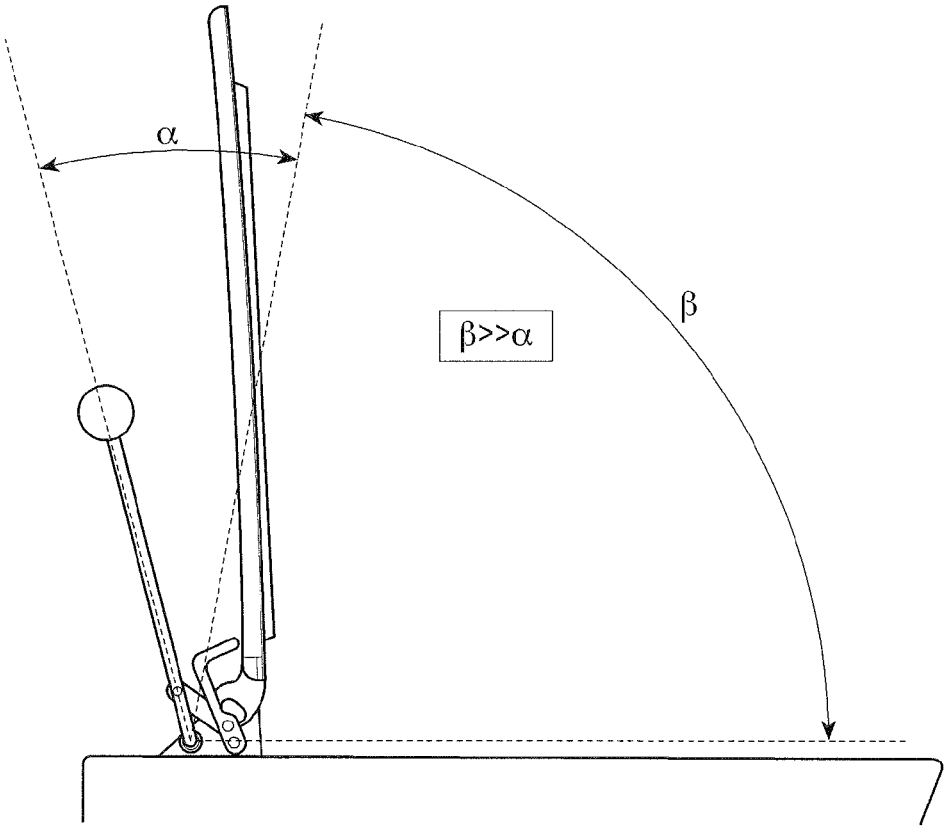
FIG. 4 illustrates the side elevation showing the extent of handle movement.
Figure 5:
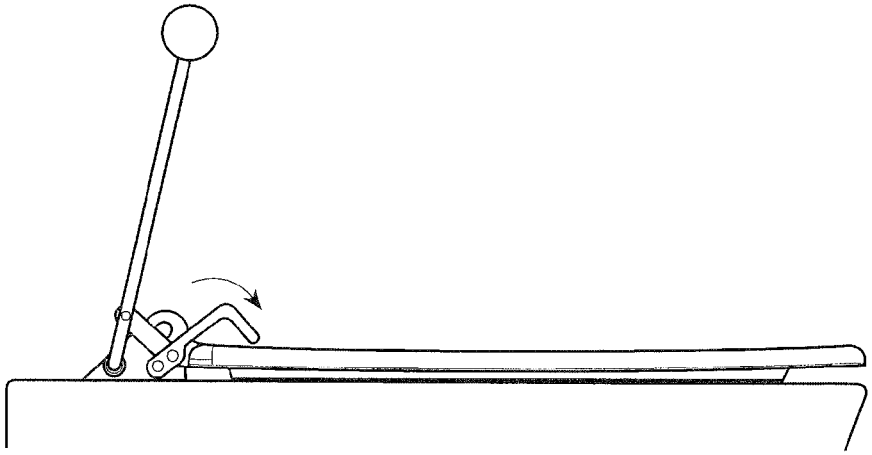
FIG. 5 illustrates the side elevation, showing the movement of an L-shaped link.
Figure 6:
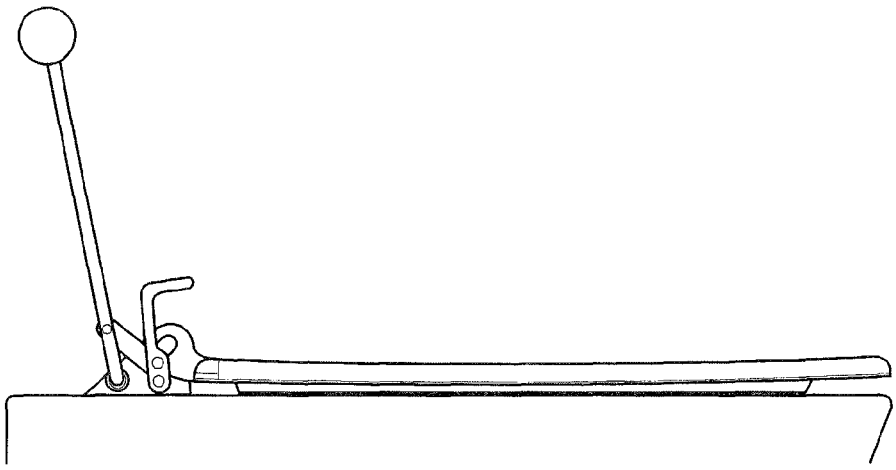
FIG. 6 illustrates the side elevation, showing the position of the handle and lever once the seat is in the horizontal position.
Figure 7:
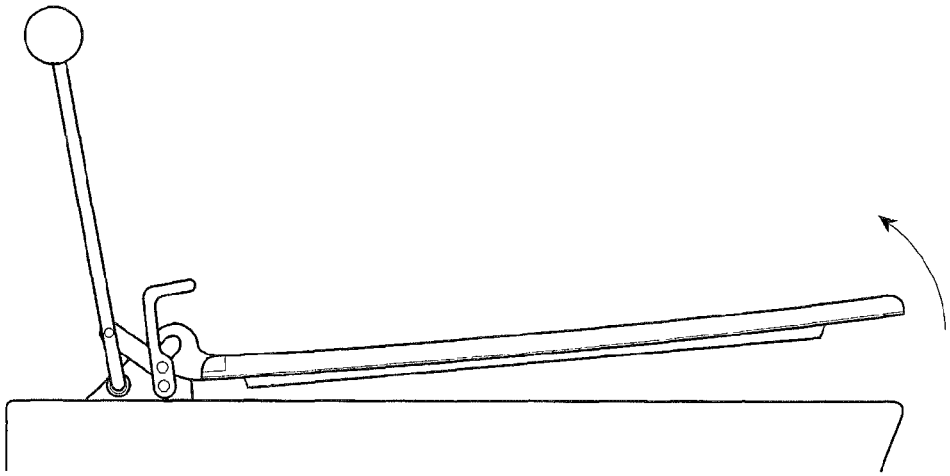
FIG. 7 illustrates the side elevation, showing the seat lifting automatically up when the handle is in the rest position shown in FIG. 6.

Referring now to FIG. 1, there is shown a toilet having a standard toilet bowl 1 and a seat 2 which is operationally associated with a spring and damper mechanism housed in a casing 4, which holds the seat in a vertical rest position. FIG. 2 shows the seat 2 in a vertical rest position, with the pull handle 3 positioned by being slightly tilted back from the seat 2, also being in a rest position. An L-shaped link 5 is also in a rest position and its longer member of the L is oriented about parallel to the pull handle 3. FIG. 4 illustrates that by pivoting the handle 3 about an angle $\alpha$, the seat 2 is being lowered with the aid of the L-shaped link 5 down by an angle $\beta$ to a horizontal position onto the bowl 1, as is illustrated in FIGS. 3 and 5, in that the pull handle acts on the L-shaped link as shown by the arrow in FIG. 5. If the seat 2 is lowered down and left in a horizontal position, as illustrated in FIG. 6, the spring and damper mechanism housed in the casing 4 act on the L-shaped link 5 and thus, pull handle 3 is moved back into its rest position by the spring forces of the mechanism as shown in FIG. 5. Depending on the strength of the damper mechanism, the seat 2 moves back into its vertical rest position, as illustrated in FIG. 7. The damping mechanism, as will be explained later, determines the speed in which the seat moves back to the rest position.

Figure 8:
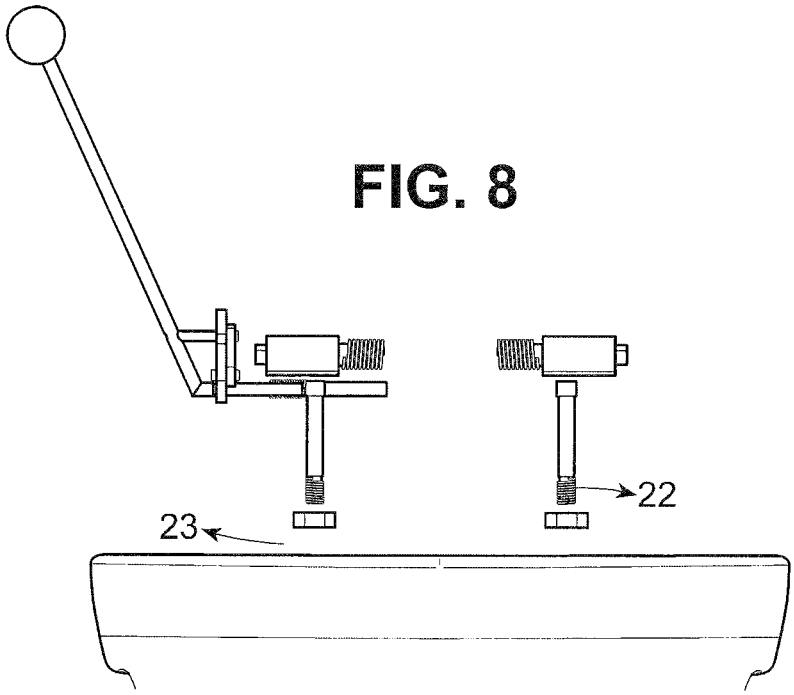
FIG. 8 illustrates a partial front view of the toilet bowl with part of the internal mechanism that operates the lifting of the seat.
Figure 9:
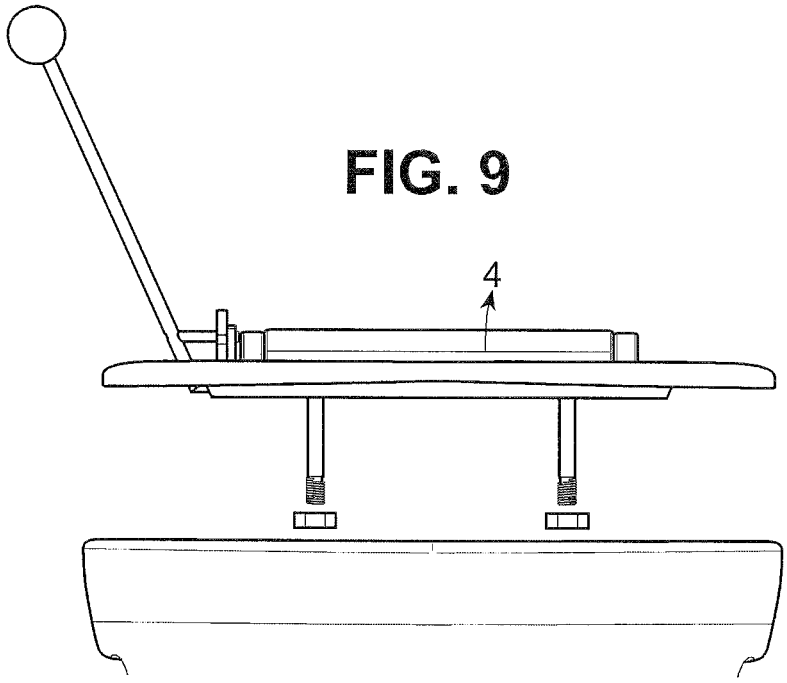
FIG. 9 illustrates a partial front view of the toilet bowl with the lifting mechanism housed in an outer casing.

FIGS. 8 and 9 show how the internal parts, housed in outer casing 4, are mounted to the bowl.

Figure 10:
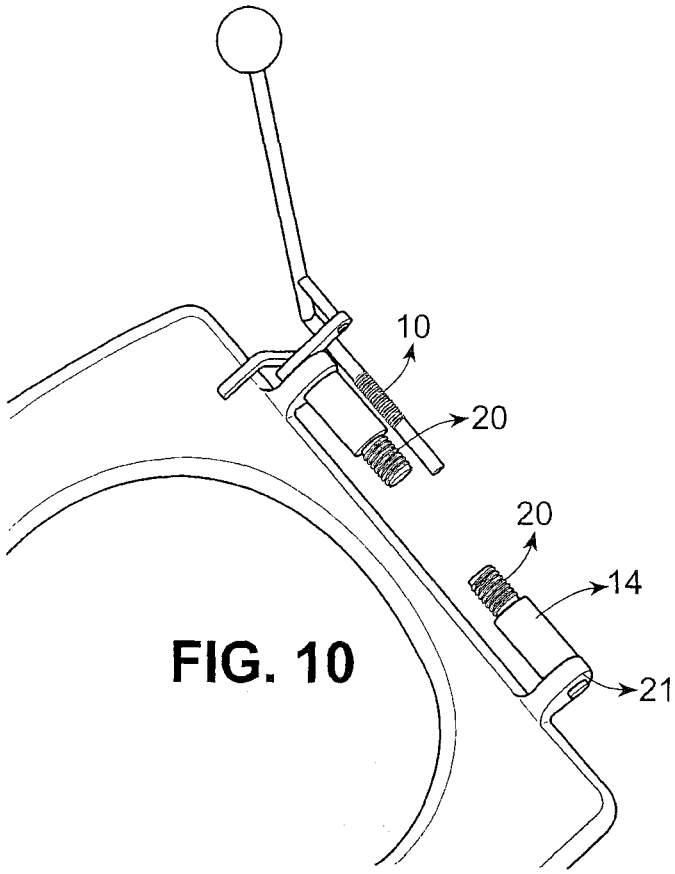
FIG. 10 illustrates a perspective view of parts of the lifting mechanism.
Figure 11:
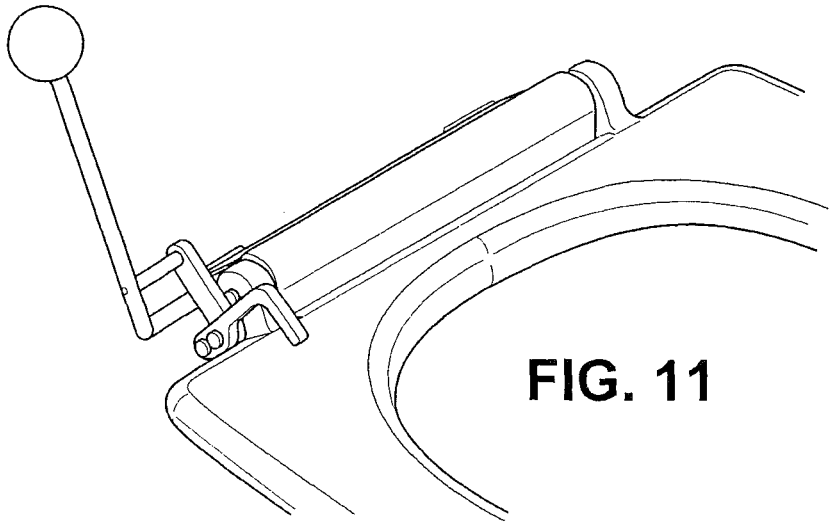
FIG. 11 illustrates a perspective view of the lifting mechanism in the casing.
Figure 14:
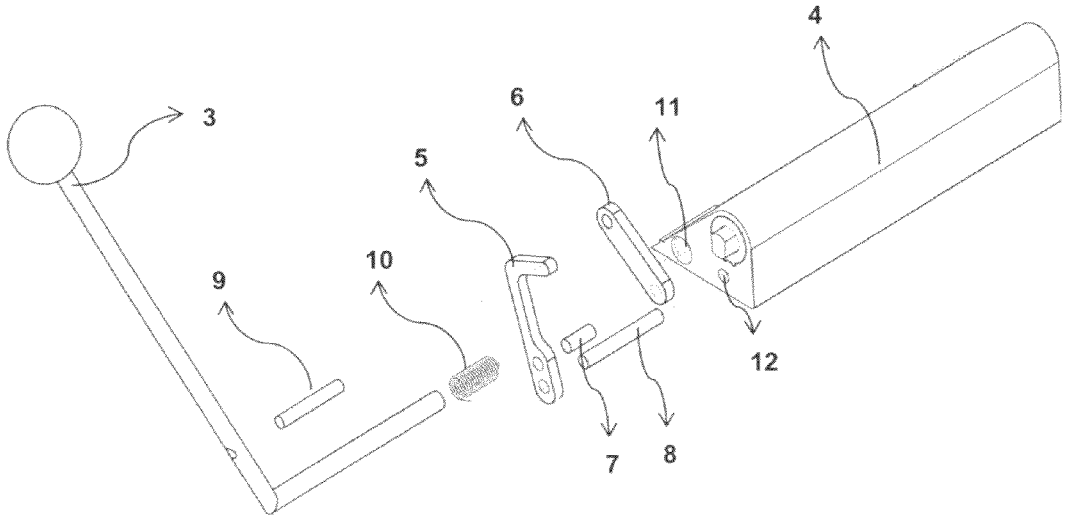
FIG. 14 illustrates an exploded view of the pull handle mechanism.

FIG. 10 shows the distribution of torsion spring 10 positioned on the L-shaped handle 3 and the torsion springs 20 on the hollow outer shaft 14. FIG. 11 shows the position of the outer casing 4. Such outer casing 4 houses the entire seat lifting mechanism. FIG. 14 shows exploded assemblies of the pull handle mechanism. Here, it can be seen that upon moving the pull handle 3 forward ("pull"), the L-shaped link 5 rotates about the pin 8 (of a four-bar-link) and pushes the toilet seat 2 to the horizontal position. As can be seen, the link 6 amplifies and transfers the pull of the handle to the L-shaped link 5 in order to lower the toilet seat 2. This is accomplished by the link 6 also being connected via a pin 9 to the shaft of the pull handle. Pin 7 connects the L-shaped link 5 and the link 6. Pin 8 connects the L-shaped link 5 to the outer casing 4 via opening 12 of the outer casing 4. A torsion spring 10 is designed to fit over the angled-off portion of the handle 3 in a way as shown in FIGS. 10 and 14 and extends into the outer casing 4 and is responsible for causing the pull handle to pivot to a defined angle $\alpha$ upon pulling. Upon letting go off the handle 3, the handle moves back to its original position due to the relaxing of the torsion spring 10. The opening 11 in the outer casing 4 accepts the shaft of the handle 3. A solid inside shaft 13 is fixed with the hinge of the toilet seat 2. When the shaft 13 rotates, it also rotates the hinge and the toilet seat 2 with it.

Figure 12A:
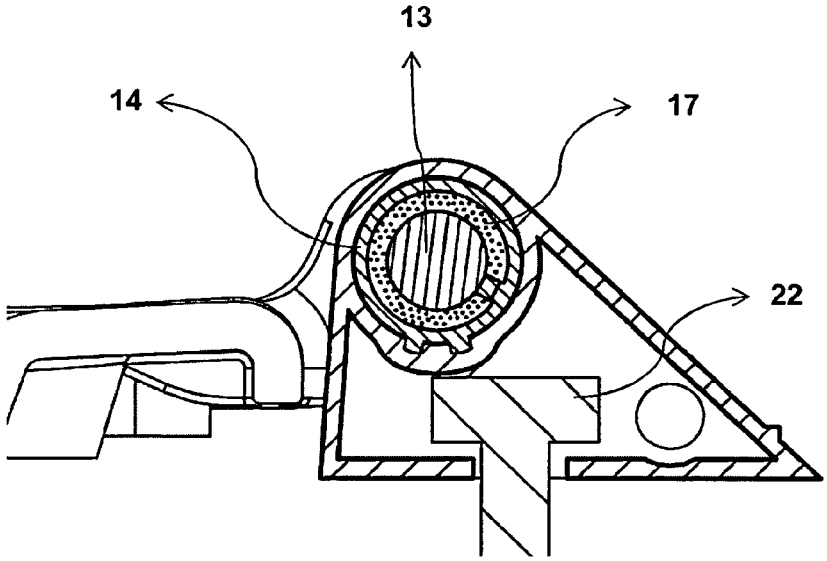
FIG. 12A illustrates a cross-section of the casing that accommodates a damper in the lifting mechanism, while the seat in horizontal position.
Figure 12B:
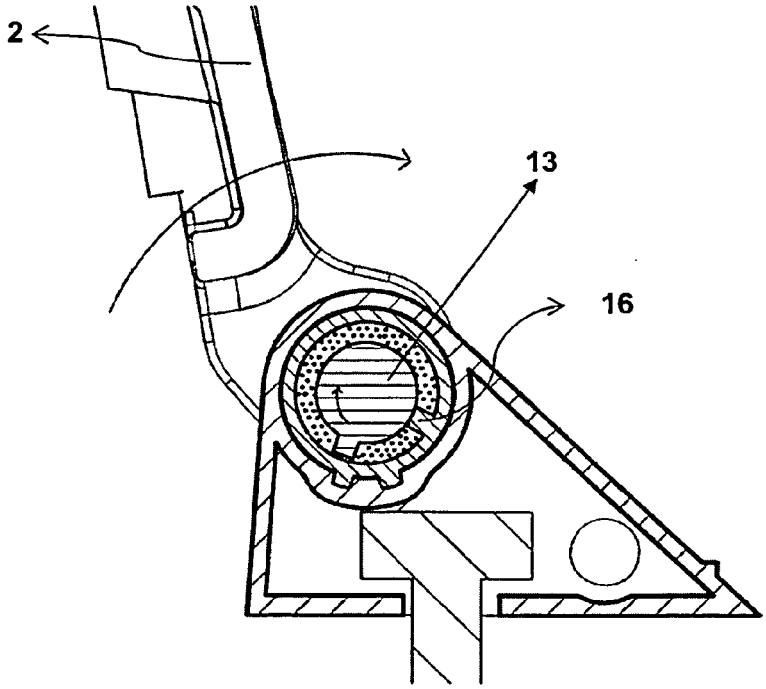
FIG. 12B illustrates a cross-section of the casing which accommodates the damper in the lifting mechanism with the seat in a vertical position.
Figure 13C:
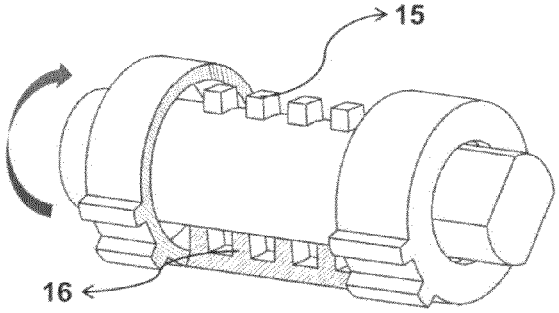
FIG. 13C illustrates a cut-away section of the damper arrangement showing the solid inside shaft and the hollow outer shaft at a point where the single row of teeth on the solid inside shaft are rotated opposite of the teeth of the single row inside teeth to the hollow outer shaft, indicating a higher speed of seat lifting.
Figure 13B:
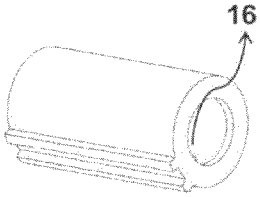
FIG. 13B illustrates a hollow shaft of the damper arrangement having a row of teeth arranged in the inside.
Figure 13A:
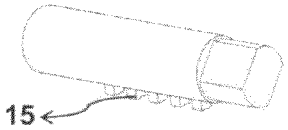
FIG. 13A illustrates a solid shaft of the damper arrangement having a row of teeth arranged on the outside.
Figure 13D:
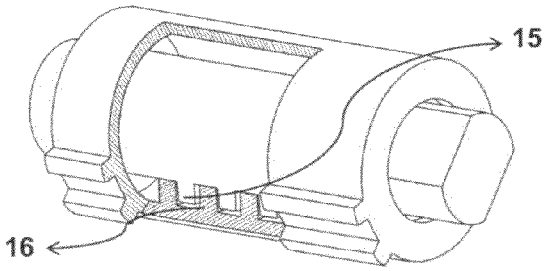
FIG. 13D illustrates the same features as shown in FIG. 13C, but shows the teeth of the solid inside shaft mashing with the row of teeth of the hollow outer shaft, indicating a lower speed of seat movement.
Figure 15:
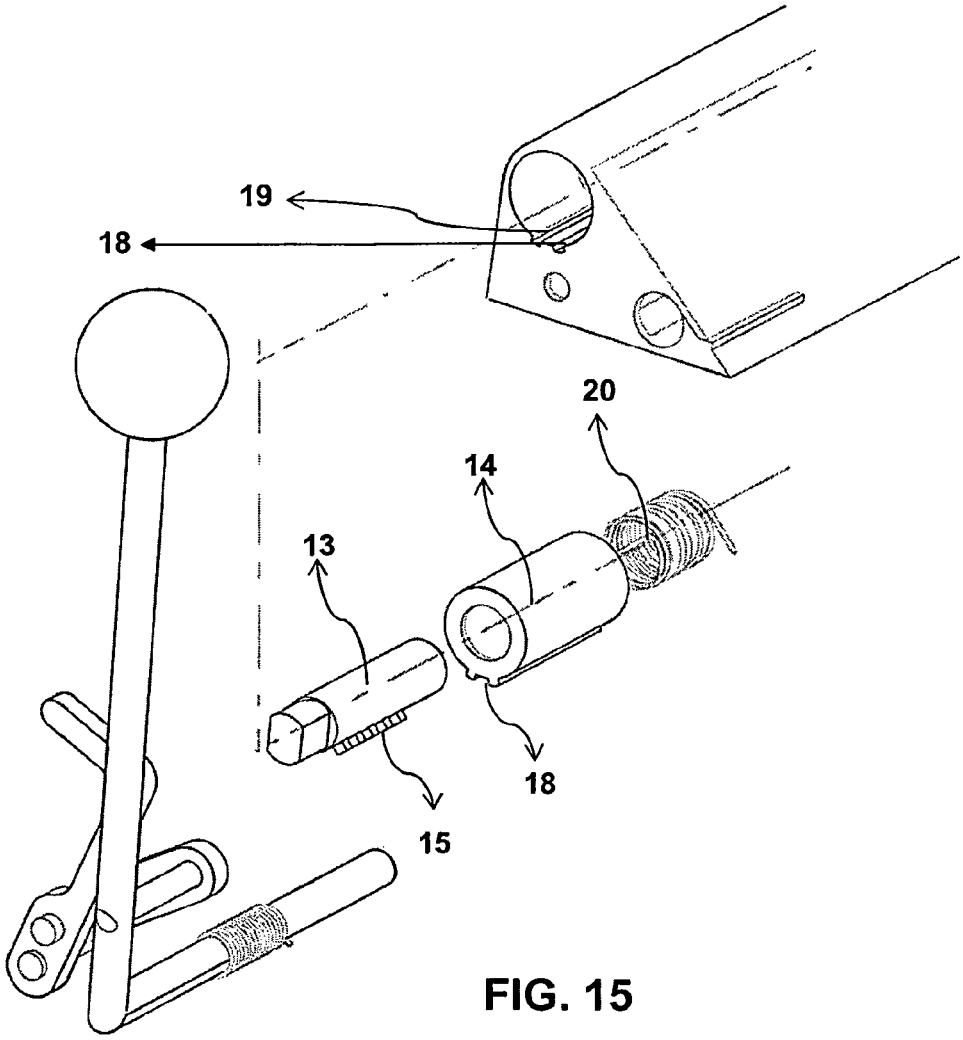
FIG. 15 illustrates an exploded view of the damper mechanism.

The outer casing 4 also includes a guide way opening 19 with guide rails 18', accepting guide rails 18, which accepts a damper mechanism, as is more closely shown in the exploded assembly shown in FIG. 15. The damper mechanism is shown to comprise a hollow shaft 14, which has a single row of teeth 16 in its inside, as illustrated in FIG. 13B. The hollow shaft 14 accepts the solid inside shaft 13 as shown in FIG. 13A, which rotates inside the hollow shaft 14. The solid inside shaft 13 also has a single row of teeth 15. As shown in FIGS. 13C and 13D, when the teeth 15 on the hollow shaft mesh with the row of teeth 16 of the solid shaft, the toilet seat starts rising very slowly. The space between the solid shaft 13 and the hollow outside shaft 14 as well as around the single row of teeth inside of shaft 14 around the teeth 15 and 16 is filled with a high viscose fluid 17 as shown in FIGS. 12A and 12B. The teeth 15 and a single row of teeth of the inside of the hollow outer shaft 14 provide high friction in the viscous fluid and create a damping effect for the seat lifting mechanism.

With the guides 18, the outer shaft 14 fits by way of the guide tracks 18' into the guide way opening 19. This fixes the outer shaft into the outer casing 4.

As is illustrated in FIG. 10, a pair of torsion springs 20 is arranged within the guide way opening 19 (see also FIG. 15) against the hollow outer shaft 14. The torsion springs force the toilet seat to come back to its original vertical position after it has been lowered by operating the pull handle 3.

As can also been seen in FIG. 10, the seat 2 has two hinges 21 which are fixed axially with the solid inner shaft 13 and rotate with it. T-Bolts 22, illustrated for example in FIG. 12 and in FIG. 8, provide mounting of the entire mechanism on the bowl by using nuts 23.

An alternative embodiment is also contemplated in which the pull handle is formed on the edge of the seat. The pulling motion is reduced to a turning motion of the handle 24, however, the same purpose is accomplished as is with the pull handle 3 for lowering the toilet seat from vertical to horizontal position. The handle can be developed for being operated by either hand of foot.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A toilet seat lifting assembly for maintaining a toilet seat in a vertical rest position when not in use, the assembly comprising a toilet seat including two fixed hinge supports, an outer casing arranged between the two hinges, a pull handle having a shaft and a base rod, the shaft being connected via a first pin to a link, the link being connected via a second pin to a pivotal L-shaped link, the base rod terminates in a first opening in the outer casing, a first torsion spring is fitted over the base rod and is, upon assembly, arranged in the first opening such that upon pivoting the pull handle out of a rest position, the first torsion spring is tensioned and upon releasing the pull handle, the torsion spring urges the pull handle back into the rest position, the L-shaped link is pivotally guided via a third pin into a second opening in the outer casing, such that the L-shaped link contacts the toilet seat and upon pivoting the pull handle out of the rest position, the L-shaped link pushes the seat down and upon relaxing of the pull handle, the torsion spring forces the seat into a vertical position.

2. The toilet seat lifting assembly according to claim 1, further comprising a damping mechanism housed in the outer casing, the damping device acts on at least one seat hinge.

3. The toilet seat lifting assembly according to claim 2, wherein the damping mechanism comprises a hollow outer shaft with at least one guide rail extending axially outside of the outer shaft, a row of teeth extending axially inside the hollow shaft, a solid shaft comprises a row of teeth on the outside and extending in an axial direction, wherein the solid shaft further comprises a fitted head portion, wherein the solid shaft is loosely fitted axially in the inside of the hollow shaft such that the row of teeth of the hollow shaft and the row of teeth of the solid shaft loosely mesh upon rotation of the solid shaft.

4. The toilet seat lifting assembly according to claim 2, wherein the damping mechanism is accommodated in a third opening in the outer casing by utilizing a second tension spring which presses the damping mechanism against the at least one seat hinge supports.

5. The toilet seat lifting assembly according to claim 4, wherein the fitted head portion pivotably engages with one of the seat hinge supports.

6. The toilet seat lifting assembly according to claim 5, wherein the third opening including at least one guide rail groove extending in an axial direction, the third opening and the at least one guide rail groove are formed to engage with the at least one guide rail of the hollow shaft.

7. The toilet seat lifting assembly according to claim 3, wherein the row of teeth of the hollow shaft and the row of teeth on the solid shaft mesh upon the solid shaft pivoting inside the outer shaft.

8. The toilet seat lifting assembly according to claim 7, wherein a damping fluid is contained between the loosely fitting solid shaft and the inside of the hollow shaft.

9. The toilet seat lifting assembly according to claim 1, further comprising two damping mechanisms housed in the outer casing, each of the damping devices acts on one seat hinge.

* * * * *